US009945274B2

(12) United States Patent
Okuma et al.

(10) Patent No.: US 9,945,274 B2
(45) Date of Patent: Apr. 17, 2018

(54) MULTI-LINK PISTON-CRANK MECHANISM FOR INTERNAL COMBUSTION ENGINE

(71) Applicant: NISSAN MOTOR CO., LTD., Yokohama-shi, Kanagawa (JP)

(72) Inventors: Satoru Okuma, Kanagawa (JP); Takashi Tanabe, Kanagawa (JP); Katsuya Moteki, Kanagawa (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 231 days.

(21) Appl. No.: 14/914,064

(22) PCT Filed: Jul. 29, 2014

(86) PCT No.: PCT/JP2014/069877
§ 371 (c)(1),
(2) Date: Feb. 24, 2016

(87) PCT Pub. No.: WO2015/029670
PCT Pub. Date: Mar. 5, 2015

(65) Prior Publication Data

US 2016/0208662 A1 Jul. 21, 2016

(30) Foreign Application Priority Data

Aug. 27, 2013 (JP) ..... 2013-175198

(51) Int. Cl.

| | |
|---|---|
| ***F01M 11/02*** | (2006.01) |
| ***F01M 1/06*** | (2006.01) |
| ***F02B 75/04*** | (2006.01) |
| ***F01M 1/08*** | (2006.01) |
| ***F02B 75/32*** | (2006.01) |

(Continued)

(52) U.S. Cl.
CPC ..... *F01M 1/06* (2013.01); *F01M 1/08* (2013.01); *F01P 3/08* (2013.01); *F02B 75/04* (2013.01);

(Continued)

(58) Field of Classification Search
CPC ..... F01M 1/06; F01M 1/08; F01M 2001/083; F02B 75/04; F02B 75/32; F02B 75/045; F02D 15/02; F01P 15/02

(Continued)

(56) References Cited

U.S. PATENT DOCUMENTS 7,980,207 B2 * 7/2011 Takahashi ..... F02B 75/048 123/48 B
8,826,882 B2 * 9/2014 Tanabe ..... F01M 11/02 123/196 R (Continued)

FOREIGN PATENT DOCUMENTS

EP 1 231 286 A1 8/2002
EP 3 037 642 A 6/2016

(Continued)

*Primary Examiner* — Marguerite McMahon
(74) *Attorney, Agent, or Firm* — Foley & Lardner LLP

(57) ABSTRACT

When the compression ratio of a variable compression ratio internal combustion engine (10) is set at a low compression ratio, a lubricating oil ejected from a lower link oil passage (25) is reflected by an upper link (11) at the piston top dead center, and supplied to a cylinder inside wall surface on the side on which a control link (15) is located in a view as viewed in the axial direction of the crank shaft. When the compression ratio of the variable compression ratio internal combustion engine (10) is set at a high compression ratio, the lubricating oil ejected from lower link oil passage (25) is reflected by upper link (11) at the piston top dead center, and supplied to the back side of the piston crown.

7 Claims, 3 Drawing Sheets

(51) Int. Cl.
*F01P 3/08* (2006.01)
*F02D 15/02* (2006.01)

(52) U.S. Cl.
CPC ..... *F02B 75/045* (2013.01); *F02B 75/32* (2013.01); *F02D 15/02* (2013.01); *F01M 2001/083* (2013.01)

(58) Field of Classification Search
USPC ..... 123/197.3, 48 B, 768 E, 196 R
See application file for complete search history.

(56) References Cited

U.S. PATENT DOCUMENTS

2004/0083992 A1* 5/2004 Nohara ..... F02B 75/048 123/78 E
2004/0163614 A1* 8/2004 Hiyoshi ..... F02B 75/045 123/48 B
2005/0045120 A1* 3/2005 Moteki ..... F02B 75/048 123/48 B
2006/0137632 A1* 6/2006 Aoyama ..... F02B 41/04 123/78 E
2010/0050992 A1* 3/2010 Nakanishi ..... F02B 75/048 123/48 B
2016/0201717 A1 7/2016 Tanabe et al.

FOREIGN PATENT DOCUMENTS

JP 03-089077 A 4/1991
JP 08-177485 A 7/1996
JP 2004-116434 A 4/2004
JP 2010-185396 A 8/2010
WO WO 01/023629 A1 4/2001

* cited by examiner

MULTI-LINK PISTON-CRANK MECHANISM FOR INTERNAL COMBUSTION ENGINE

TECHNICAL FIELD

The present invention relates to a multi-link piston-crank mechanism for an internal combustion engine.

BACKGROUND ART

A multi-link piston-crank mechanism for an internal combustion engine is known. This multi-link piston-crank mechanism includes: an upper link which is connected with a piston through a piston pin; a lower link which is rotatably attached to or mounted on a crank pin of a crank shaft and which is connected swingably with the upper link through a first connecting pin; a control link which includes a first end connected swingably with the lower link through a second connecting pin; and a control shaft which is rotatably attached to or supported by a cylinder block and which is provided with an eccentric shaft supporting a second end of the control link swingably. This multi-link piston-crank mechanism is arranged so that the first connecting pin is located on one side of a cylinder center axial line and the second connecting pin is located on the other side of the cylinder center axial line.

In this multi-link piston-crank mechanism, a force is applied to the piston in the direction pressing the piston to the cylinder inside wall surface on the side on which the control link lies as viewed in the axial direction of the crank shaft, owing to the construction of this mechanism.

For a multi-link piston-crank mechanism of the above-mentioned type, a patent document 1 discloses an arrangement including an oil supply hole having a forward open end opening in a thrust bearing surface around the crank pin of the crank shaft, and an oil guide groove which is formed in an annular flange surface of the lower link sliding on the thrust bearing surface, and which extends in the radial direction of the crank pin and aligns with the forward open end of the oil supply hole at a predetermined swing posture of the lower link. With this arrangement, a lubricating oil (oil jet) is supplied to the inside wall surface of the cylinder from the lower link along the oil guide groove.

However, in the arrangement, as an example, in which the center of the crank pin is always set off largely to the other side with respect to the cylinder center axial line in the view in the crank shaft axial direction, the crank pin is located toward the other side beyond the cylinder inside wall surface on the control link's side. Therefore, in the above-mentioned multi-link piston-crank mechanism, it is not possible in some cases to set the direction of the oil guide groove extending in the radial direction of the crank pin toward the cylinder inside wall surface on the control link's side without regard to the swing posture of the lower link.

PRIOR ART DOCUMENT

Patent Document

Patent document 1: JP2010-185396A

SUMMARY OF THE INVENTION

According to the present invention, a multi-link piston-crank mechanism for an internal combustion engine, comprises an upper link connected with a piston, a lower link attached rotatably to, or mounted rotatably on, a crank pin of a crank shaft and connected swingably with the upper link through a first connecting pin, a control link including one end, or first end, connected swingably with the lower link through a second connecting pin, and a control shaft which is attached rotatably to, or supported rotatably by, a cylinder block and which is provided with an eccentric shaft supporting the other end, or second end, of the control link swingably, the first connecting pin being located on one side, or first side, of a cylinder center axial line and the second connecting pin being located on the other side, or second side, of the cylinder center axial line, wherein the lower link is formed with a lower link oil passage which communicates with a crank pin oil passage extending in a radial direction of the crank pin, at a predetermined swing posture of the lower link, and ejects a lubricating oil toward the upper link, and the upper link is arranged to reflect or throw back the lubricating oil ejected from the lower link oil passage and thereby to supply or direct the lubricating oil to a cylinder inside wall surface on a side on which the control link is located as viewed in an axial direction of the crank shaft.

According to the present invention, the multi-link piston-crank mechanism can direct the lubricating oil to the cylinder inside wall surface receiving thrust pressure or load of the piston, that is the cylinder inside wall on the side on which the control link is located in the view in the crank shaft axial direction, and thereby restrain scuffing of the piston in the multi-link piston-crank mechanism.

MODE(S) FOR CARRYING OUT THE INVENTION

Figure 1:
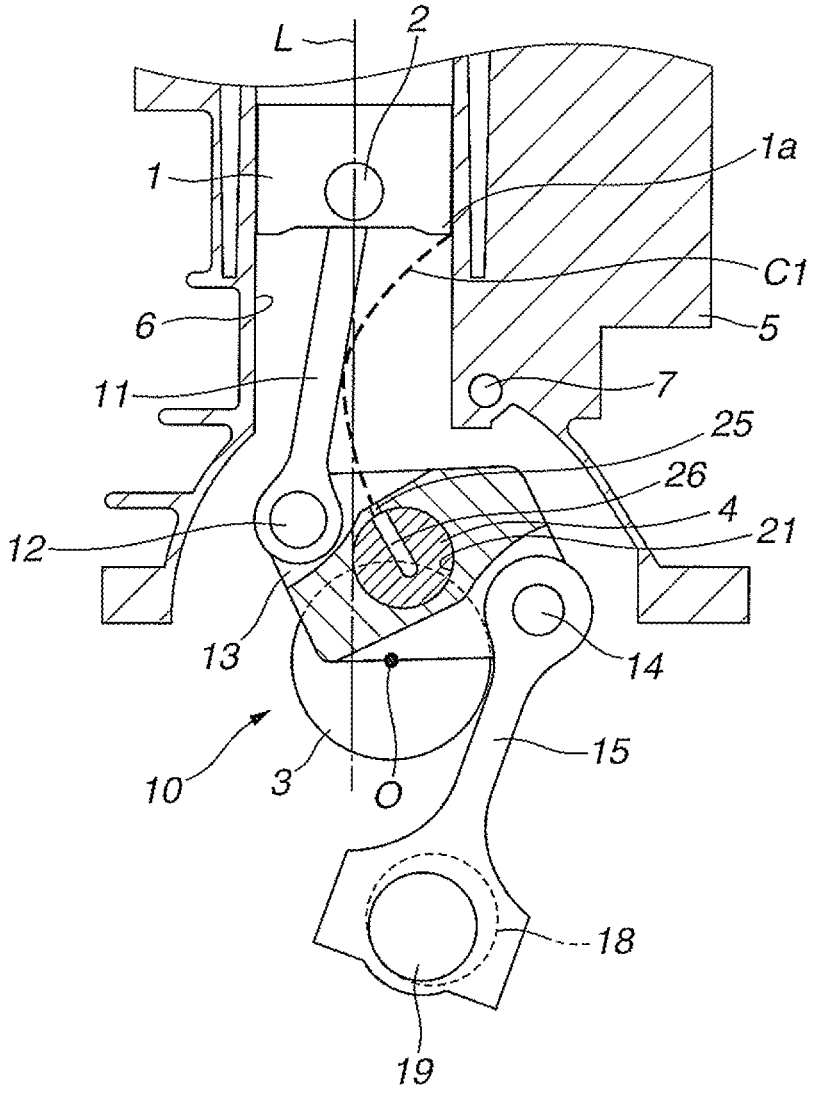
FIG. 1 is a view schematically showing a reciprocating type variable compression ratio internal combustion engine to which a multi-link piston-crank mechanism according to the present invention is applied.
Figure 2:
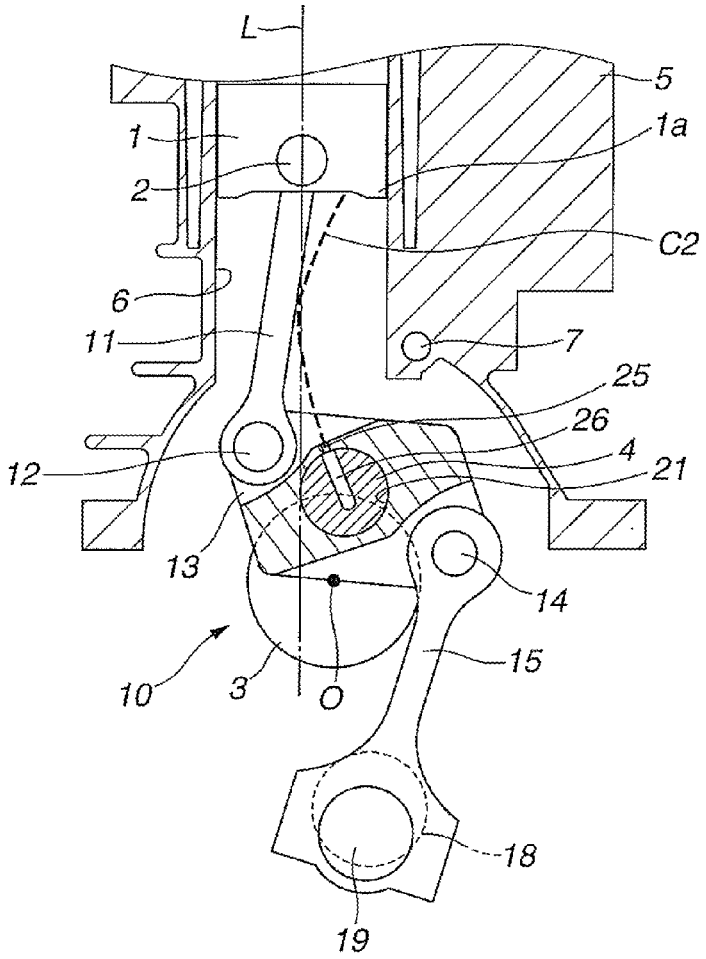
FIG. 2 is a view schematically showing the reciprocating type variable compression ratio internal combustion engine to which the multi-link piston-crank mechanism according to the present invention is applied.

One embodiment of the present invention is explained hereinafter with reference to the drawings. FIGS. 1 and 2 are views schematically showing the basic construction of a reciprocating type variable compression ratio internal combustion engine 10 to which a multi-link piston-crank mechanism according to the present invention is applied, as one example. FIG. 1 shows a state of a lower compression ratio, and FIG. 2 shows a state of a higher compression ratio.

A piston 1 is disposed slidably in a cylinder 6 formed in a cylinder block 5. One end of an upper link 11 is connected swingably with this piston 1 through a piston pin 2.

The other end of upper link 11 is connected rotatably with one end of a lower link 13 through an upper pin 12 as a first connecting pin. The lower link 13 includes a central portion formed with a crank pin through hole 21 through which a crank pin 4 of a crank shaft 3 extends. For assembly with the crank pin 4, the lower link 13 is made up of two sections, upper and lower sections or left and right sections, which are joined together by unshown bolt(s). Crank shaft 3 rotates about a point O as a center.

The other end of lower link 13 is connected rotatably with one end of a control link 15 through a control pin 14 as a second connecting pin. The other end of control link 15 is supported swingably by a part of the main body of the internal combustion engine, and arranged so that the position of fulcrum for the swing motion is movable relative to the main body of the internal combustion engine in order to vary the compression ratio. Specifically, there is provided a control shaft 18 extending in parallel to the crank shaft 3, and the other end of control link 15 rotatably fits over an eccentric shaft 19 provided eccentrically in the control shaft 18. The control shaft 18 is supported rotatably with respect to cylinder block 5 and linked with an unshown appropriated actuator mechanism.

Therefore, the center position of eccentric shaft 19 serving as the swing fulcrum of control link 15 is moved relative to the engine main body when the control shaft 18 is rotated by the above-mentioned actuator mechanism to vary the compression ratio. With this movement, the mechanism changes the motion constraint condition of control link 15 constraining the motion of lower link 13, hence changes the position of stroke of piston 1 with respect to the crank angle, and eventually vary the engine compression ratio.

FIGS. 1 and 2 further show a main gallery 7 conveying a lubricating oil of a high pressure.

Figure 3:
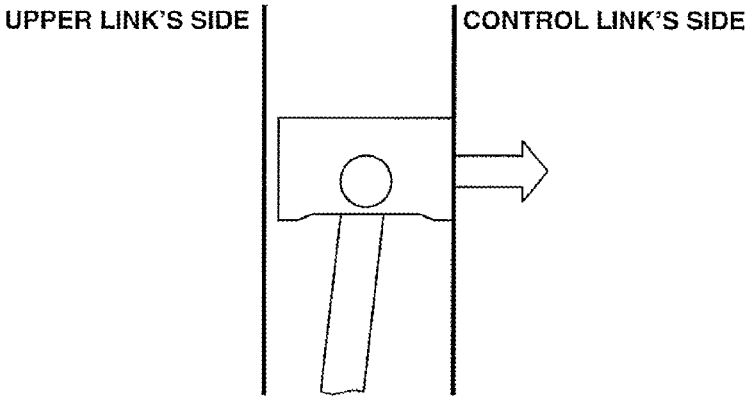
FIG. 3 is a schematic view for illustrating the direction of a thrust force in the multi-link piston-crank mechanism.
Figure 4:
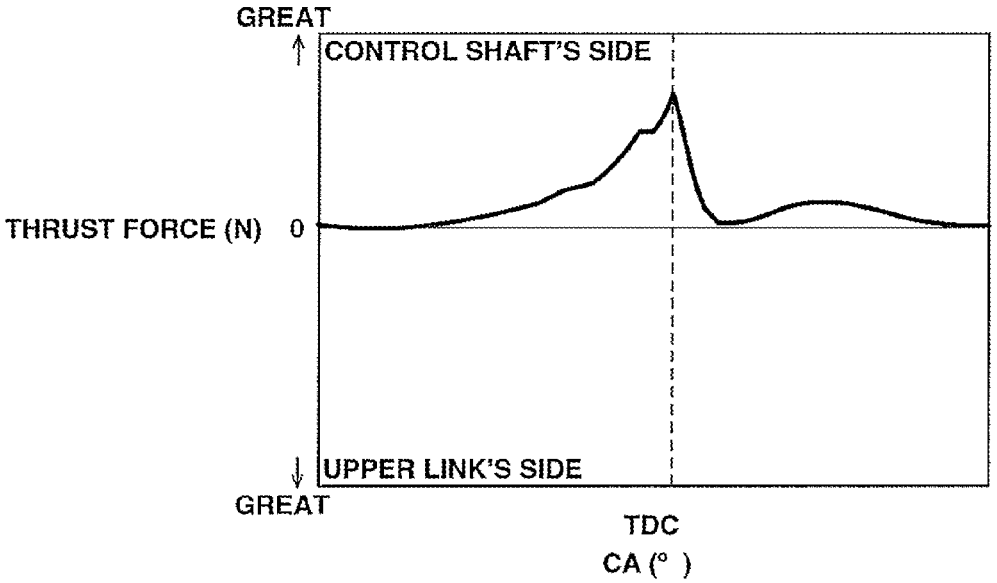
FIG. 4 is a characteristic view showing the variation of the thrust force acting on the piston in the multi-link piston-crank mechanism.

In the variable compression ratio internal combustion engine 10, the mechanism is so constructed that the upper pin 12 connecting the upper link 11 and lower link 13 is located on one side, or first side, of a center axial line L of the cylinder whereas the control pin 14 connecting the lower link 13 and control link 15 is located on the other side, or second side, of the cylinder center axial line L. Therefore, as shown in FIG. 3, a force is applied to piston 1 in the direction pushing piston 1 to the inside cylinder wall surface on the side on which control link 15 lies as viewed in the axial direction of the crank shaft. In other words, as shown in FIG. 4, the thrust force acting on piston 1 is directed only in the direction toward the side on which the control link 15 is located (to the right side as viewed in FIG. 1 and FIG. 2). The thrust force acting on piston 1 becomes greatest at the piston top dead center position.

Therefore, the variable compression ratio internal combustion engine 10 is arranged to supply the lubricating oil ejected from a lower link oil passage 25 formed in lower link 13, to the cylinder inside wall surface on the side on which control link 15 is located in the view in the axial direction of the crank shaft.

The lower link oil passage 25 is formed so that the lower link oil passage 25 communicates with a crank pin oil passage 26 formed in crank pin 4 when lower link 13 is in a predetermined swing posture and to eject the lubricating oil flowing in from the crank pin oil passage 26, toward upper link 11. The lubricating oil ejected in the direction toward upper link 11 is reflected or bounced back and directed to the cylinder inside wall surface on the side on which control link 15 is located as viewed in the axial direction of the crank shaft. The crank pin oil passage 26 extends in the radial direction of crank pin 4, and is connected with the main gallery 7 through an unshown oil passage formed in the crank shaft 3.

The lower link oil passage 25 in this embodiment communicates with crank pin oil passage 26 and ejects the lubricating oil toward upper link 11 when the piston is at the top dead center.

Specifically, when the compression ratio of variable compression ratio internal combustion engine 10 is set at a low compression ratio, as shown by a thick broken line C1 in FIG. 1, the lubricating oil jetting from lower link oil passage 25 is reflected or bounced back by upper link 11, and directed to a region in the cylinder inside wall surface on the side on which control link 15 is located in the view as viewed in the axial direction of the crank shaft, near a skirt 1*a* of piston 1. Therefore, at the time of start of the variable compression ratio internal combustion engine 10, the lubricating oil is supplied to the cylinder inside wall surface on the side on which control link 15 is located as viewed in the axial direction of the crank shaft. Moreover, when the compression ratio of variable compression ratio internal combustion engine 10 is set at a high compression ratio, as shown by a thick broken line C2 in FIG. 2, the lubricating oil jetting from lower link oil passage 25 is reflected or bounced back by upper link 11, and directed to the back side of the piston crown.

Therefore, at the time of a start from a long time inoperative state or a cold start at a low temperature, the mechanism can supply the lubricating oil to the cylinder inside wall surface on the side to which the piston 1 is pressed, and thereby prevent scuffing of piston 1.

When the compression ratio of variable compression ratio internal combustion engine 10 is set at a higher ratio, the piston temperature is increased by the increase of the compression ratio, as compared to the temperature increase in the lower compression ratio setting. Therefore, the mechanism can restrain the increase of the piston temperature by supplying the lubricated oil reflected or bounced by upper link 11, to the back side of the piston crown.

Since the lubricating oil is ejected from lower link oil passage 25 at the time of piston top dead center, the lubricating oil is supplied to the cylinder inside wall surface on which piston 1 is to slide just after the ejection of lubricating oil when the compression ratio is lower. Therefore, the supply of lubricating oil is more effective for restraining scuffing of piston 1. When the compression ratio is higher, the lubricating oil is supplied to the back side of the piston crown at the timing when the temperature of piston 1 becomes higher, so that the supply of lubricating oil is more effective for restraining increase of the piston temperature.

The mechanism is arranged to supply the lubricating oil to the desired position via upper link 11 redirecting the lubricating oil ejected from lower link oil passage 25. Therefore, the freedom in setting the position of lower link oil passage 25 is high relatively, and it is possible to form the lower link oil passage 25 in a portion of lower link 13 where the stress is not concentrated.

For supplying the lubricating oil to the cylinder inside wall surface on the side on which control link 15 is located as viewed in the axial direction of the crank shaft, it is possible to conceive a arrangement in which upper link 11 is formed with an oil passage extending continuously from lower link 13, and arranged to eject the lubricating oil from upper link 11. As compared to this comparative arrangement, the embodiment does not require the operation for forming an oil passage in upper link 11 and hence prevent scuffing of piston 1 less costly. Furthermore, the arrangement of the embodiment for prevent scuffing of piston 1 is less costly as compared to another conceivable arrangement in which cylinder block 5 is formed with a sub gallery continuous with main gallery 7 on the side on which upper link 11 is located as viewed in the axial direction of the crank shaft, and the lubricating oil is ejected from the side on which upper link 11 is located to the cylinder inside wall surface on which control link 15 is located as viewed in the axial direction of the crank shaft.

The angle of reflection of the lubricating oil ejected from lower link oil passage 25 by upper link 11 is adjustable by angle(s) of upper link 11 and/or lower link 13. Moreover, this angle of reflection is adjustable by forming recess or projection in the portion of upper link 11 for reflecting the lubricating oil.

Furthermore, it is possible to set the timing of ejecting the lubricating oil from lower link oil passage 25 at a timing other than the top dead center.

In the multi-link piston-crank mechanism according to the illustrated embodiment: as shown in FIGS. 1 and 2, the first connecting pin is located on a first side (left side) of the cylinder center axial line (L); the second connecting pin 14 is located on a second side (right side) of the cylinder center axial line (L) opposite to the first side; the lower link oil passage 25 of the lower link 13 is opened to eject the lubricating oil toward the first side or in a predetermined first (or ejecting) direction toward the upper link 11 at the time of the predetermined swing posture of the lower link; and the upper link 11 includes a portion (such as an intermediate portion) to redirect the lubricating oil jetting out from the lower link oil passage 25 toward the upper link 11 and bumping against or striking the upper link 11, from the first (ejecting) direction to a second direction toward the target region of the cylinder inside wall surface on the second (right) side to supply the lubricating oil to the target region of the cylinder inside wall surface. The first (ejecting) direction of the lower link oil passage 25 is not toward the target region of the cylinder inside wall surface on the second (right) side, but toward the upper link on the first (left) side, away from the target region of the cylinder inside wall surface on the second (right) side.

In FIG. 1, the first (ejecting) direction is an inclined upward direction toward the piston 1, inclined to the first (left) side. The second direction is an inclined upward direction inclined to the second (right) side. Therefore, the lubricating oil is driven through a curved course shown by the broken line C1 in FIG. 1, to the target region of the inside cylinder wall surface. As shown in FIGS. 1 and 2, upper link 11 bends the course (C1) more largely to a greater curvature in the case of FIG. 1, than the curved course shown by the broken line C2 in FIG. 2.

According to one of aspects of the present invention, a multi-link piston-crank mechanism for an internal combustion engine, comprises: upper link means (11) for transmitting movement from a piston which is slidably received in a cylinder, by being connected with the piston through a piston pin; lower link means (13), mounted rotatably on a crank pin of a crank shaft, for receiving movement from the upper link means by being connected swingably with the upper link means through first connecting means (12) located on a first side (left side in FIG. 1) of a predetermined imaginary center plane (L) extending in parallel to an axis of the crank shaft and passing through or bisecting the piston (or bisecting the piston pin); control link means (15) including a first end (upper end) connected swingably with the lower link means through second connecting means (14) located on a second side (right side in FIG. 1) of the center plane (L) opposite to the first side, for constraining movement of the lower link means; actuating means (18, 19, etc.) for supporting a second end (lower end) of the control link means swingably (to vary a constraint condition of the lower connecting means or to vary a compression ratio of the engine); and lubricating means (25, 26, etc.) for supplying a lubricating oil to a predetermined region or target region of a cylinder inside wall surface of the cylinder on the second side of the center plane. The lubricating means comprises ejecting means (25) for ejecting the lubricating oil from the lower link means toward the first side (left side), and redirecting means (11), included in the upper link means, for receiving the lubricating oil ejected toward the first side by the ejecting means and redirecting a course of the lubricating oil toward the second side to supply the lubricating oil to the target region of the cylinder inside wall surface on the second side.

In one of practical examples according to the present invention, the upper link means includes upper link 11 at least, the lower link means includes lower link 13 at least, the control link means includes control link 15 at least, the actuating means includes at least one of a control shaft 18, an eccentric shaft 19 and an actuating mechanism for rotating the control shaft 18, the lubricating means includes at least one of lower link oil passage 25, crank pin oil passage 26, the unshown (axially extending) oil passage formed in the crank shaft, and main gallery 7, the ejecting means includes the lower link oil passage 25 at least, and the redirecting means includes a portion of the upper link 11 which may be intermediate between both ends of the upper link and which may be shaped and oriented to redirect the lubricating oil toward the target region of the cylinder inside wall surface smoothly at a predetermined swing posture of the lower link means.

The invention claimed is:

1. A multi-link piston-crank mechanism for an internal combustion engine, comprising an upper link connected with a piston through a piston pin, a lower link attached rotatably to a crank pin of a crank shaft and connected swingably with the upper link through a first connecting pin, a control link including one end connected swingably with the lower link through a second connecting pin, and a control shaft which is attached rotatably to a cylinder block and which includes an eccentric shaft supporting the other end of the control link swingably, the first connecting pin being located on one side of a cylinder center axial line and the second connecting pin being located on the other side of the cylinder center axial line, wherein the lower link is formed with a lower link oil passage which communicates with a crank pin oil passage extending in a radial direction of the crank pin, at a predetermined swing posture of the lower link, and ejects a lubricating oil toward the upper link to cause the lubricating oil to be reflected by the upper link, and the upper link is arranged to reflect the lubricating oil ejected from the lower link oil passage and thereby to supply the lubricating oil to a cylinder inside wall surface on a side on which the control link is located as viewed in an axial direction of the crank shaft.

2. The multi-link piston-crank mechanism as claimed in claim 1, wherein the multi-link piston-crank mechanism is arranged to supply the lubricating oil reflected by the upper link, to the cylinder inside wall surface near a skirt of the piston at a time of piston top dead center.

3. The multi-link piston-crank mechanism as claimed in claim 1, wherein the multi-link piston-crank mechanism is adapted to control an eccentric shaft position of the control shaft in accordance with an engine operating condition and thereby to vary an engine compression ratio, and the multi-link piston-crank mechanism is arranged to supply the lubricating oil reflected by the upper link, to the cylinder inside wall surface near a skirt of the piston when the engine compression ratio is set at a low compression ratio.

4. The multi-link piston-crank mechanism as claimed in claim 3, wherein the multi-link piston-crank mechanism is arranged to supply the lubricating oil reflected by the upper link, to a back side of a crown of the piston when the engine compression ratio is set at a high compression ratio.

5. The multi-link piston-crank mechanism as claimed in claim 1, wherein the multi-link piston-crank mechanism is adapted to control an eccentric shaft position of the control shaft in accordance with an engine operating condition and thereby to vary an engine compression ratio, and the multi-link piston-crank mechanism is arranged to supply the lubricating oil reflected by the upper link, to the cylinder inside wall surface near a skirt of the piston at a time of piston top dead center when the engine compression ratio is set at a low compression ratio, and to supply the lubricating oil reflected by the upper link, to a back side of a crown of the piston at the time of piston top dead center when the engine compression ratio is set at a high compression ratio.

6. The multi-link piston-crank mechanism as claimed in claim 1, wherein the first connecting pin is located on a first side of the cylinder center axial line; the second connecting pin is located on a second side of the cylinder center axial line opposite to the first side; the lower link oil passage of the lower link is opened to eject the lubricating oil in a predetermined first direction toward the upper link on the first side, away from a target region of the cylinder inside wall surface on the second side; and the upper link includes a portion to redirect the lubricating oil jetting out from the lower link oil passage toward the upper link and bumping against the portion of the upper link, from the first direction to a second direction toward the target region of the cylinder inside wall surface on the second side to supply the lubricating oil to the target region of the cylinder inside wall surface.

7. A multi-link piston-crank mechanism for an internal combustion engine, comprising upper link means for transmitting movement from a piston slidably received in a cylinder, by being connected with the piston through a piston pin;

lower link means, mounted rotatably on a crank pin of a crank shaft, for receiving movement from the upper link means by being connected swingably with the upper link means through first connecting means located on a first side of a predetermined imaginary center plane extending in parallel to an axis of the crank shaft and passing through the piston;

control link means including a first end connected swingably with the lower link means through second connecting means located on a second side of the center plane opposite to the first side, for constraining movement of the lower link means;

actuating means for supporting a second end of the control link means swingably; and lubricating means for supplying a lubricating oil to a target region of a cylinder inside wall surface of the cylinder on the second side of the center plane, the lubricating means comprising, ejecting means for ejecting the lubricating oil from the lower link means toward the first side, and redirecting means, included in the upper link means, for receiving the lubricating oil ejected toward the first side by the ejecting means and redirecting a course of the lubricating oil toward the second side to supply the lubricating oil to the target region of the cylinder inside wall surface on the second side.

* * * * *